US005698973A

United States Patent [19]

Goerke et al.

[11] Patent Number: 5,698,973

[45] Date of Patent: Dec. 16, 1997

[54] SOFT-START SWITCH WITH VOLTAGE REGULATION AND CURRENT LIMITING

[75] Inventors: Ulrich B. Goerke, Boylston; Mark S. Pieper, Marlboro, both of Mass.

[73] Assignee: Data General Corporation, Westborough, Mass.

[21] Appl. No.: 690,540

[22] Filed: Jul. 31, 1996

[51] Int. Cl.[6] ..... G05F 1/10

[52] U.S. Cl. ..... 323/901; 323/238; 363/49

[58] Field of Search ..... 323/238, 285, 323/901; 363/49

[56] References Cited

U.S. PATENT DOCUMENTS

| | | | |
|---|---|---|---|
| 5,015,921 | 5/1991 | Carlson et al. | 315/208 |
| 5,045,771 | 9/1991 | Kislovski | 323/285 |
| 5,257,156 | 10/1993 | Kirkpatrick | 323/901 |
| 5,376,831 | 12/1994 | Chen | 327/379 |
| 5,528,132 | 6/1996 | Doluca | 323/901 |
| 5,619,127 | 4/1997 | Warizaya | 363/49 |

*Primary Examiner*—Stuart N. Hecker
*Attorney, Agent, or Firm*—Bromberg & Sunstein LLP

[57] ABSTRACT

A MOSFET, an op-amp, a comparator circuit, and voltage dividers with capacitors are employed in combination to effectuate a soft-start switch with current limiting. The transconductance of the MOSFET is employed so that no sense resistor is required. The MOSFET and op-amp are configured as a closed-loop feedback circuit in which the output of the op-amp is coupled to the gate of the MOSFET and the inverting input of the op-amp is coupled to the output of the soft-start switch via a voltage divider. A first RC circuit provides a voltage to the non-inverting input of the op-amp which can be triggered to gradually me from a value close to zero to some reference voltage so as to soft-start a load. Current limiting means are effectuated by a comparator circuit and voltage dividers with capacitors. The current limiting means brings the MOSFET to an OFF state and the non-inverting input of the op-amp close to zero volts if the op-amp charges a second RC circuit so that the voltage drop across its capacitor exceeds a pre-determined limit-reference, and also, once the current limiting means brings the MOSFET to the OFF state, the current limiting means allows the soft-start switch to begin a soft-start power-up after a pre-determined time dependent upon the time constant of the second RC circuit.

34 Claims, 5 Drawing Sheets

SOFT-START SWITCH WITH VOLTAGE REGULATION AND CURRENT LIMITING

FIELD OF THE INVENTION

This invention relates to a soft-start switch with a MOSFET. More particularly, this invention relates to a soft-start switch in which the voltage drop across the soft-start switch is regulated, the current supplied to a load is kept below a maximum current value without the need for a sense resistor by employing the transconductance relationship between the gate-source voltage and the drain-source current of the MOSFET, and in which the soft-start trunction is performed automatically when a load is applied, without the need of additional sense signals.

BACKGROUND OF THE INVENTION

A soft-start switch is a switching device placed between a power supply and a load. The soft-start switch when first turned ON provides to the load a voltage that gradually rises from zero to some desired level. Often the rise in voltage takes the form of the familiar rising voltage vs. time curve of a charging capacitor in an RC circuit. See, for example, FIG. 1 where the voltage supplied to the load, denoted as $V_{out}$, exponentially rises to a reference voltage, denoted as $V_{ref}$.

It is desirable to add a current limiting feature to a soft-start switch so that the current supplied to a load is kept below some maximum current value, so as to prevent excessive current damage to the load and the connectors, and to reduce unwanted perturbations in other circuits powered by the power supply powering the soft-switch. For example, a hard-disk drive when first powered-up is largely a capacitive load, and if it is powered-up by a simple switch it is possible that an excessively large current may be drawn by the hard-disk drive.

An example of a prior art soft-start switch 1 is illustrated in FIG. 2, where MOSFET 10 serves as a voltage-controlled current device with gate 12 coupled to the output of op-amp 20, drain 16 coupled to the input 30 of the soft-start switch 1, and source 14 coupled to the anode of Schottky diode 40. Input 30 of soft-start switch 1 is coupled to a power supply (not shown) with voltage $V_0$. The output 50 of soft-start switch 1 provides a voltage $V_{out}$ to load 55. Load 55 may be an active load. Schottky diode 40 is included to prevent current from being drawn back into soft-start switch 1 if there is a failure in the power supply, but otherwise it is not important to the functioning of the soft-start switch. A reference voltage $V_{ref}$, where $V_{ref}<V_0$, is provided to terminal 62 of resistor 60 with resistance R. To node 70 is coupled the other terminal of resistor 60, the non-inverting input 22 of op-amp 20, and one terminal of capacitor 90 with capacitance C. The other terminal of capacitor 90 is grounded. Switching means 80 can ground node 70, thereby discharging capacitor 90 and grounding the non-inverting input 22 of op-amp 20. The inverting input 24 of op-amp 20 is coupled to output 50, thus providing feedback by way of the output of op-amp 20 controlling the gate voltage of MOSFET 10, thereby controlling the drain-source current and in turn the voltage $V_{out}$ applied to load 55. The output voltage of op-amp 20 is assumed to lie between ground and some voltage $V_{cc}$, where $V_{cc}$ is sufficient to put MOSFET 10 into or close to saturation. Without loss of generality we let the ground voltage be zero.

The MOSFET is OFF ($V_{out}$=0) when switching means 80 grounds node 70. Assuming capacitor 90 has been fully discharged, soft-start switch 1 initiates a soft-start power-up when switching means 80 decouples node 70 from ground, thereby allowing capacitor 90 to charge. Thus, the voltage of non-inverting input 22 is given by $V_{ref}[1-\exp(-t/RC)]$. Because of the feedback loop, the op-amp adjusts the gate voltage of MOSFET 10 so that $V_{out}=V_{ref}[1-\exp(-t/RC)]$, thus providing the soft-start capability with $V_{out}$ given in FIG. 1.

Switching means 80 may perform a current limiting function by switching MOSFET 10 OFF when too much current is being drawn through the MOSFET and into the load. FIG. 3 illustrates a prior art soft-start switch with current limiting. Components in FIG. 3 are referenced by the same numeral as corresponding identical components in FIG. 2. The soft-start switch of FIG. 3 is a modification of soft-start switch 1 of FIG. 2 in which a sense resistor 100 is placed in the current path from MOSFET 10 to load 55. The voltage drop $\Delta V$ across sense resistor 100 is coupled via 102 and 104 to switching means 80. When $\Delta V$ is greater than some reference voltage, indicating that the current is too large, switching means 80 grounds node 70, thereby turning the MOSFET OFF.

It should be appreciated that the prior art soft-start switch of FIGS. 2 or 3 regulates $V_{out}$ in the sense that the drain-source current of MOSFET 10 is controlled via its gate-source voltage so that $V_{out}$ is made to follow the non-inverting voltage of op-amp 20. However, it may be more desirable to regulate the voltage drop $V_0$-$V_{out}$ rather than the voltage $V_{out}$. For example, more than one power supply may provide power to a soft-start switch, where one power supply serves as a back-up for the others. The system may be designed so that one power supply can handle all the power requirements, but it is desirable that all functioning power supplies share equally in supplying power to the load. Unbalanced load sharing may happen when the power supply with the largest output voltage supplies most of the current, and thereby most of the power to the load. To achieve load sharing, the power supplies are built such that the output voltage of a power supply is gradually lowered when it is determined that there is unequal load sharing. It is therefore desirable that $V_{out}$ also drop gradually in the same amount that $V_0$ drops when equal load sharing is sought. Consequently, it is more desirable to regulate the voltage drop $V_0$-$V_{out}$ than $V_{out}$.

Another problem associated with the prior art soft-start switch of FIGS. 2 or 3 arises when a capacitive load is hot-plugged to the soft-start switch. For example, a hard-disk when first powered-up presents a capacitive load. It is desirable that a hard-disk drive can be unplugged from the system and replaced with another hard-disk drive "hot-plugged" into the system, i.e., the new hard-disk drive is coupled to a soft-start switch without powering down the system. Hot-plugging a capacitive load brings $V_{out}$ momentarily close to zero, thereby increasing the voltage drop across the drain and source terminals of MOSFET 10 to approximately $V_0$. Because of parasitic capacitances between the gate and drain and between the gate and source inherent in a MOSFET, the sudden increase in voltage drop across the drain and source terminals induces a sudden increase in gate-source voltage. Because the MOSFET is a transconductance device (it is a voltage-controlled current source), this increase in gate-source voltage results in an undesirable high source-drain current. Although switching means 80 will eventually turn the MOSFET OFF when a large current surge is detected, it is more desirable that the MOSFET never turn ON in the first place. Therefore, it is advantageous that a soft-start switch with no load connected has the MOSFET turned OFF (gate-source voltage less than the MOSFET threshold voltage) even though switching means 80 is not grounding node 70 and capacitor 90 is charged, and that the switching means keeps the MOSFET OFF even when a capacitive load is hot-plugged to the soft-start switch.

Yet another problem associated with the prior art switch of FIG. 3 is that power is dissipated through the sense resistor 100. Although sense resistors have small resistance, a load may draw several or more amps (for example a hard-disk drive), and therefore the heat dissipation of sense resistor 100 must be accounted for. Also, accurate sense resistors add an additional cost.

Therefore, it is desirable that the prior art soft-start switch of FIGS. 1 or 2 be improved such that the voltage drop $V_0$-$V_{out}$ is regulated, the MOSFET is held OFF when no load is applied or when a capacitive load is hot-plugged, and current limiting is accomplished without a sense resistor. The embodiments of the present invention described hereinafter accomplish these improvements.

SUMMARY OF THE INVENTION

An advantage of the present invention is a soft-start switch with regulation of voltage drop across the soft-start switch, i.e., $V_0$-$V_{out}$, so that load sharing among a plurality of power supplies coupled to the same soft-start switch is facilitated.

Another advantage of the present invention is a soft-start switch in which a load may be hot-plugged to the soft-start switch without causing a current surge.

Another advantage of the present invention is a soft-start switch that automatically soft-starts a hot-plugged load.

Yet another advantage of the present invention is a soft-start switch with current limiting without the need for a sense resistor.

In the preferred embodiment of the invention to be disclosed, a MOSFET, an op-amp, a comparator circuit, diodes, and voltage dividers with capacitors are employed in combination to effectuate a soft-start switch. The MOSFET and op-amp are configured as a closed-loop feedback circuit in which the output of the op-amp is coupled to the gate of the MOSFET and the inverting input of the op-amp is coupled to the output of the soft-start switch via a voltage divider. A first RC circuit provides a voltage to the non-inverting input of the op-amp which can be triggered to gradually rise from a value close to zero (typically one diode voltage drop above ground) to some reference voltage. The combination of the first RC circuit and closed-loop feedback circuit controls the current through the MOSFET such that the output voltage of the soft-start switch rises gradually from a value close to zero to the reference voltage when the MOSFET is initially turned ON. Current limiting means are effectuated by a comparator circuit and voltage dividers with capacitors. The current limiting means brings the MOSFET to an OFF state and the non-inverting input of the op-amp close to zero volts if the op-amp charges a diode-capacitor circuit so that the voltage drop across its capacitor exceeds a pre-determined reference, and also, once the current limiting means brings the MOSFET to the OFF state, the current limiting means allows the soft-start switch to begin a soft-start power-up after a pre-determined time dependent upon the time constant of a second RC circuit.

BRIEF DESCRIPTION OF THE DRAWINGS

The accompanying drawings explain the principles of the invention in which.

DETAILED DESCRIPTION OF THE PREFERRED EMBODIMENTS

Figure 4:
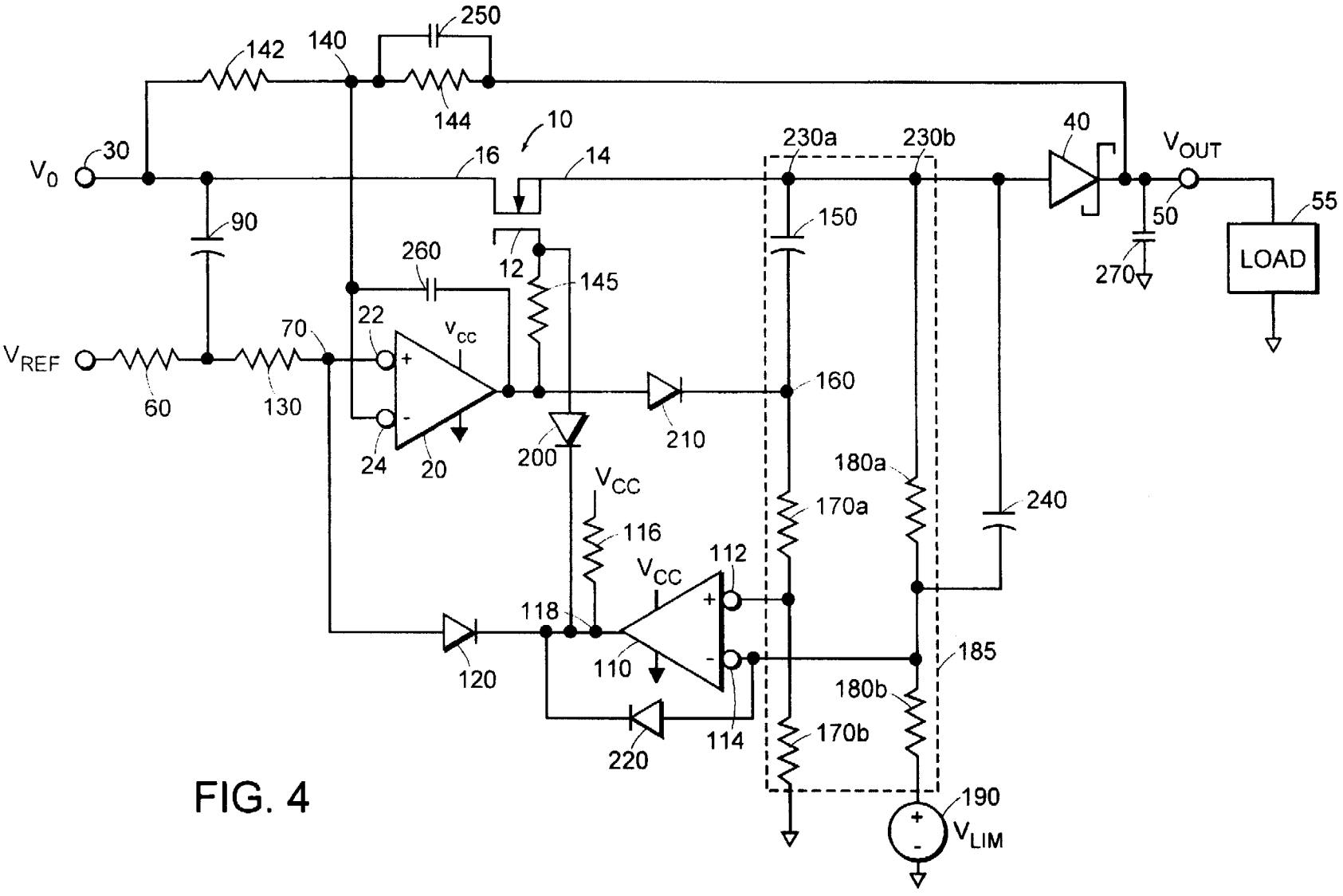
FIG. 4 illustrates an embodiment of the invention.

FIG. 4 illustrates an embodiment of the invention in which components with a corresponding component in the previous figures are labeled with the same reference number. The operation of the circuit in FIG. 4 and how it achieves the advantages of the invention as outlined in the Summary will now be explained.

The device labeled 110 is an open-collector comparator with inverting input 112 and non-inverting input 114. Pull-up resistor 116 is coupled to a voltage $V_{cc}$, where $V_{cc}>V_{ref}$. If the voltage at input 114 is greater than the voltage at input 112, then the pull-up resistor 116 with voltage $V_{cc}$ will bring the voltage at node 118 to $V_{cc}$, thereby reverse biasing diode 120 and allowing capacitor 90 to discharge so that its terminal closest to the bottom of FIG. 4 is at voltage $V_{ref}$. When the voltage at input 114 is less than the voltage at input 112, the comparator brings the voltage at node 118 to ground, which brings the cathode of diode 120 to ground and node 70 to one diode voltage drop above ground, thereby allowing capacitor 90 to charge so that the potential difference across its plates rises from $V_0$-$V_{ref}$ to approximately $V_0$. Note that as capacitor 90 is charging, current is limited by flowing through resistor 130. Without resistor 130, comparator 110 would not be able to rapidly bring node 70 down to one diode voltage drop above ground because of the finite current capacity of an open-collector comparator.

Figure 2:
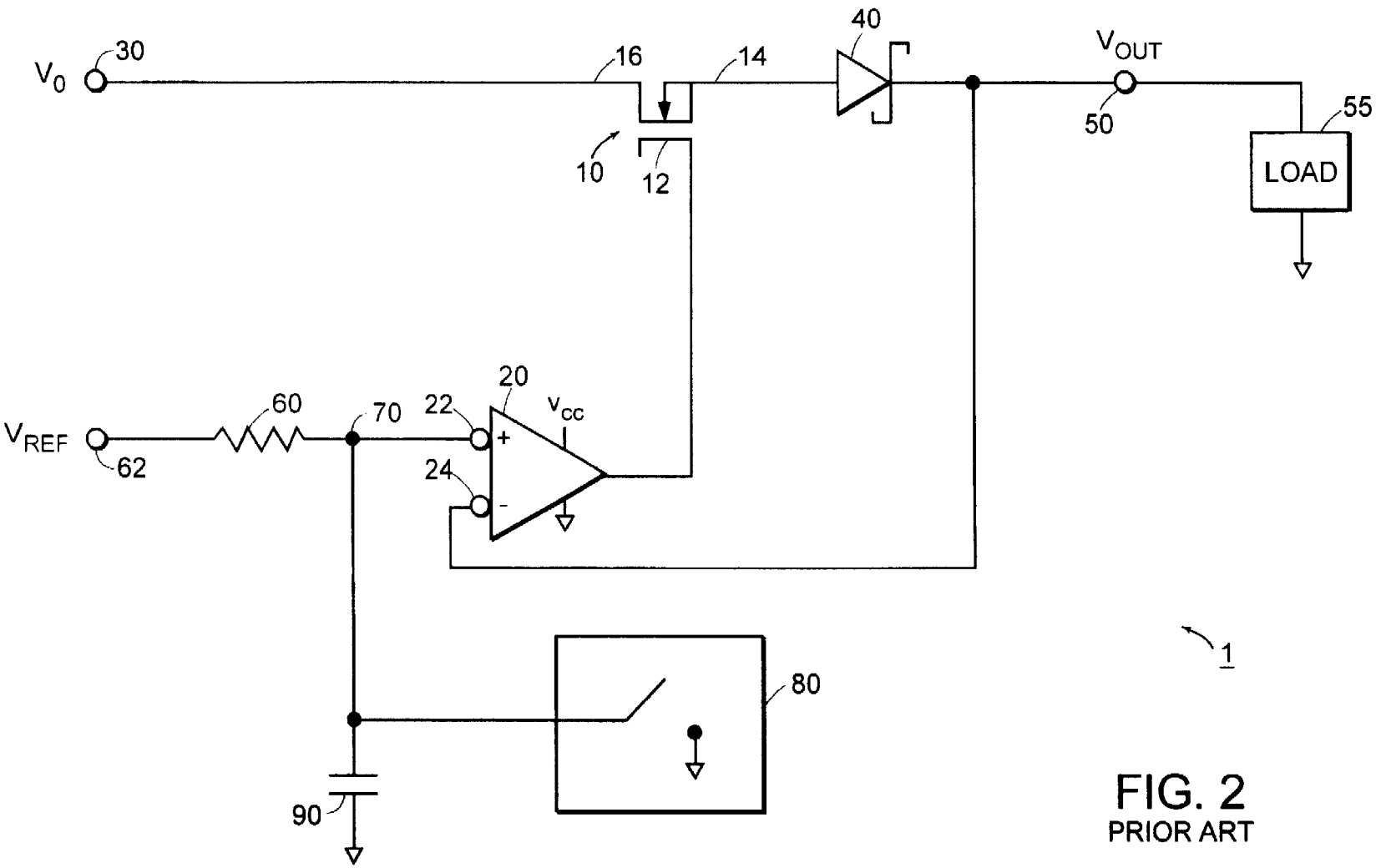
FIG. 2 PRIOR ART
FIG. 2 illustrates a prior art soft-start switch.
Figure 3:
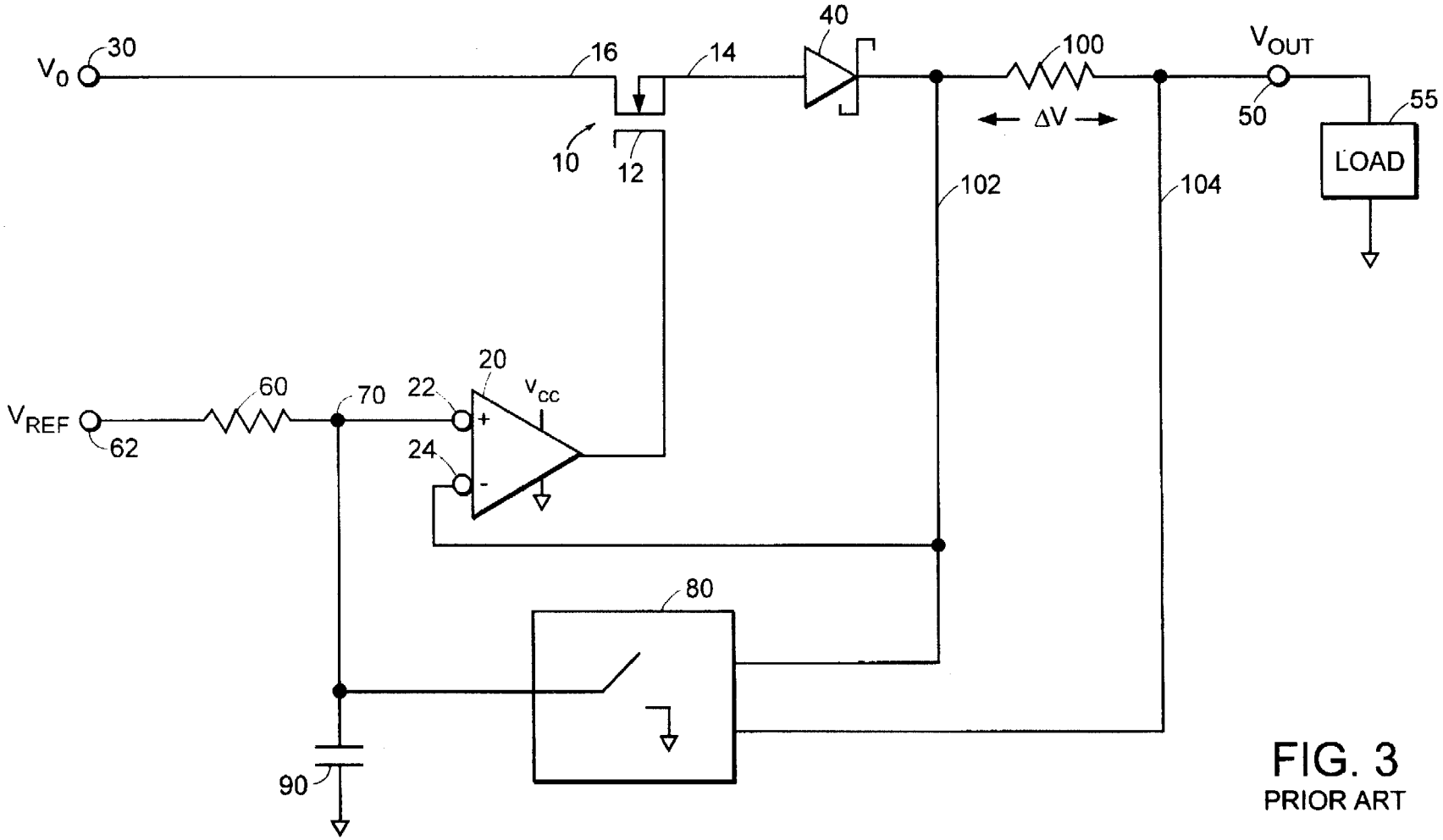
FIG. 3 PRIOR ART
FIG. 3 illustrates a prior art soft-start switch with prior art current limiting.

Note that one terminal of capacitor 90 is coupled to a terminal of resistor 60 as in FIGS. 2 and 3, but that the other terminal of capacitor 90 is coupled to input 30 rather than ground. This configuration brings about some subtle differences when compared to the prior an switch of FIG. 2 or 3. It should be appreciated that capacitor 90 of FIG. 4 is charging when the voltage difference between its two terminals is increasing, and is discharging when the voltage difference is decreasing. For purposes of explaining the embodiments of the present invention, we shall refer to capacitor 90 as charged when the voltage difference between its terminals is approximately $V_0$ and as discharged when the voltage difference is $V_0$-$V_{ref}$. Unlike the prior art switch of FIG. 2 or 3, the RC circuit in FIG. 4 defined by resistor 60 and capacitor 90 presents to node 70 the voltage $V_{ref}$ when it is discharged, and presents to node 70 approximately zero volts (one diode voltage drop above ground) when it is charged. The voltage at node 70 when diode 120 is reverse biased will still be approximately governed by the equation $V_{ref}[1-\exp(-t/RC)]$ as for the prior art switch of FIG. 2 or 3, but now t=0 refers to the time that capacitor 90 starts from a charged state in which the potential difference across its terminals is approximately $V_0$ and begins to discharge to a final potential difference of $V_0$-$V_{ref}$.

The advantage obtained over the prior art by coupling one terminal of capacitor 90 to input 30 rather than to ground is that fluctuations in the voltage $V_0$ applied to input 30 will cause similar fluctuations in the voltage at non-inverting input 22, and consequently similar fluctuations in output voltage $V_{out}$ by way of the feedback means accomplished by op-amp 20. This feature is desirable if $V_0$ is being purposely reduced because of the load sharing problem as discussed earlier. In other words, by coupling one terminal of capacitor 90 to input 30 rather than to ground, the circuit of FIG. 4 is regulating the voltage drop $V_0$-$V_{out}$, rather than $V_{out}$ directly, thereby achieving one of the advantages of the invention.

The soft-start switch of FIG. 4 may be modified in which the terminal of the capacitor coupled to input 30 is instead coupled to ground, as in the prior art. Such a modified soft-start switch will achieve the other advantages of the present invention, but will not have the additional advantage of regulating the voltage drop $V_0$-$V_{out}$ rather than $V_{out}$ directly.

Note that inverting input 24 of op-amp 20 is no longer coupled directly to output 50 as in the prior art switch of FIG. 2 or 3, but is instead coupled to node 140 of the voltage divider defined by resistors 142 and 144. The resistance of resistor 142 is chosen substantially larger than the resistance of resistor 144 so that the voltage at node 140 is close to $V_{out}$ when load 55 is present. However, consider the case in which load 55 is not present, or when it is an infinite impedance, in which case there is no current flowing through resistors 142 and 144, which brings the voltage at node 140 to $V_0$. Then the voltage at inverting input 24 of op-amp 20 is at $V_0$. However, the voltage at the non-inverting input 22 is never larger than $V_{ref}$, which is lower than $V_0$, and therefore the output of op-amp 20 is saturated low at ground. Consequently, when no load is present, gate 12 of MOSFET 10 is held at ground even though capacitor 90 may be discharged. Therefore, hot-plugging a capacitive load, such as a hard-disk drive, will not immediately cause an increase in gate voltage due to parasitic capacitances within the MOSFET because the gate 12 is initially held at ground. However, hot-plugging a capacitive load will quickly bring $V_{out}$ to zero momentarily, which will bring the voltage at inverting input 24 close to zero, in which case the output voltage of op-amp 20 will slew up toward voltage $V_{cc}$ which it applies to gate 12. Therefore, to limit current surge and to initiate a soft-start when a capacitive load is hot-plugged, it is necessary to continue to keep gate 12 at ground potential and to bring node 70 to ground potential (or at least within one diode voltage drop from ground) for at least a period of time sufficiently long so that capacitor 90 has time to charge. The additional circuitry not yet discussed in FIG. 4 will achieve these advantages, and will furthermore provide current limiting if load 55, whether hot-plugged or not, tries to draw an excessive amount of current. This additional circuitry and its operation will now be discussed.

Let us continue with the discussion of hot-plugging a capacitive load in which prior to hot-plugging, the soft-start switch of FIG. 4 is initially in a state where capacitor 90 is discharged (which assumes that the output of comparator 110 is $V_{cc}$ so that diode 120 is reverse biased). As discussed above, because of the voltage divider defined by resistors 142 and 144, the gate voltage of MOSFET 10 is initially at zero (ground) volts when no load is present. However, with $V_{out}$ brought quickly to zero (ground) due to hot-plugging a capacitive load, the output of op-amp 20 will slew high toward $V_{cc}$ because the voltage at node 140 will be close to zero while the voltage at node 70 is still at $V_{ref}$. But because of resistor 145, the series "RC" circuit presented by resistor 145 and the capacitance of gate 12 will charge-up at a slower rate than capacitor 150 due to the lack of a resistor between capacitor 150 and the op-amp output (remember that the terminal of capacitor 150 closest to the top of FIG. 4 is momentarily one Schottky voltage drop above zero volts). Thus, capacitor 150 will rapidly charge up to toward $V_{cc}$ when $V_{out}$ is brought close to zero due to hot-plugging a capacitive load.

With the voltage at node 160 approaching $V_{cc}$, consider the voltage divider defined by resistors **170*a* and 170*b*, which are of equal value. This voltage divider will present a voltage approaching $V_{cc}/2$ at inverting input 112 of comparator 110. Consider now the voltage divider defined by resistors 180*a* and 180*b*, which are of equal value, and voltage source 190 with voltage $V_{lim}$ where $V_{cc}>V_{lim}$ (its significance will be discussed later). The function of capacitor 240 is discussed later, and for now we ignore its presence when considering the voltage divider 180*a*–180*b*. Consequently, this voltage divider presents a voltage at non-inverting input 114 close to $V_{lim}/2$. Therefore, because $V_{cc}>V_{lim}$, the output voltage of comparator 110 will go to zero, which rapidly brings gate 12 and node 70 to one diode voltage drop above zero because of diodes 200 and 120, respectively. Thus, the MOSFET stays in the OFF state, thereby keeping $V_{out}$ at zero and limiting current to the capacitive load, and capacitor 90 charges. Furthermore, the ratio of the resistance of resistor 142 to to the resistance of resistor 144 is chosen such that the voltage at inverting input 24 will be larger than one diode voltage drop for most practical values of $V_0$ and therefore the output of op-amp 20 will saturate to zero. Also, with the output voltage of comparator 110 at zero, diode 220 is forward biased, and therefore clamps the input 114** to one diode voltage drop above ground.

We therefore see that hot-plugging a capacitive load puts the soft-start switch of FIG. 4 in a state where MOSFET 10 is OFF, $V_{out}$ is zero, capacitor 90 is charging, the output of op-amp 20 is saturated to zero, input 114 is at one diode voltage drop above ground, comparator 110 is at zero volts output, and capacitor 150 is charged up to $V_{cc}$. The soft-start switch of FIG. 4 will now soon be ready to soft-start load 55, which we now discuss.

With diode 210 now reverse biased (because op-amp 20 is saturated to zero voltage output), capacitor 150 will now discharge through resistors **170*a* and 170*b* to ground. The voltage at 112 will decay with a time constant determined by capacitor 150 and resistors 170*a* and 170*b*. Eventually the voltage at 112 will decay below one diode voltage drop, in which case node 118 is pulled up by resistor 116 to a voltage of $V_{cc}$, thereby reverse biasing diodes 120, 200, and 220, and allowing capacitor 90 to discharge and the soft-start switch to soft-start load 55. The time constant of capacitor 150 and resistors 170*a* and 170*b* should be chosen to be sufficiently long so that capacitor 90** has time to be fully charged before a soft-start power-up begins.

Therefore from the above discussion, we see that the soft-start switch of FIG. 4 achieves the advantage of allowing a capacitive load, such as a hard-disk drive, to be hot-plugged without a large surge in current and furthermore provides automatic soft-starting of the hot-plugged load.

Now consider the case in which the circuit of FIG. 4 with load 55 is in a steady state where capacitor 90 is discharged, node 118 is at voltage $V_{cc}$ (i.e., comparator 110 is at output voltage $V_{cc}$ and diodes 120, 200, and 220 are reversed biased), and MOSFET 10 is ON. We now discuss how the circuit of FIG. 4 limits current to load 55 if the load tries to draw an excessive amount of current. For example, the load may be a hard-disk drive malfunctioning.

First, consider the voltage dividers **170*a*–170*b* and 180*a*–180*b*. Nodes 230*a* and 230*b* are at the same voltage, which is the source voltage $V_S$ of source 14 of MOSFET 10. Node 160 is, to within one diode-voltage drop, equal to the gate voltage $V_g$ of gate 12. (The voltage drop across resistor 145 can be ignored because of the negligible current drawn by gate 12.) For simplicity, we ignore the small forward voltage drop across diode 210. It can easily be shown that the voltage divider 170***a*–170*b* presents a voltage of $V_-=V_g/2=(V_S+V_{gs})/2$ to input 112 where $V_{gs}$ is the gate-source voltage. Also, it can be shown that the voltage divider 180*a*–180*b* presents a voltage of $V_+=(V_s+V_{lim})/2$ to input 114 (remember that the output of the comparator is at $V_{cc}$ so that diode 220 is reversed biased). Consequently, the comparator will change its state from a high voltage of $V_{cc}$ to zero voltage when $V_-$ transitions above $V_+$, or equivalently, when $V_{gs}$ transitions above $V_{lim}$.

We thus see that the sub-circuit within the dashed lines referenced with numeral 185 presents to comparator 110 two voltages indicative of whether $V_{gs}$ is smaller or greater than $V_{lim}$, ignoring the effect of capacitor 240 on the function of the divider. Other equivalents of sub-circuit 185 can be constructed by one of ordinary skill in the art of electronics. The effect of capacitor 240 on the circuit will be discussed shortly.

By taking advantage of the transconductance associated with MOSFET 10, sub-circuit 185 will turn MOSFET 10 OFF if load 55 tries to draw an excessive amount of current. The transconductance of a MOSFET is denoted by G, where $I_D=G\cdot V_{gs}$ and $I_D$ is the source-drain current. We assume that the MOSFET is not put into saturation, so that the transconductance equation holds. We see that $V_{gs}$ must increase in order for $I_D$ to increase. Now suppose that load 55 malfunctions and tries to draw an excessive amount of current, in other words, the impedance of load 55 suddenly decreases. The MOSFET can be considered a voltage-controlled current device. A sudden decrease in the impedance of load 55 does not immediately cause a larger $I_D$, but rather, the voltage $V_{out}$ decreases. Because of the closed-loop feedback, op-amp 20 will try to keep $V_{out}$ close to $V_{ref}$ by increasing its output voltage so as to increase the gate-source voltage $V_{gs}$ which in turn would increase $I_D$ which in turn would increase $V_{out}$. In particular, when the MOSFET is close to saturation, G decreases, so that an even larger increase in $V_{gs}$ is required to increase $I_D$ compared to the case in which the MOSFET is not close to saturation. As the op-amp tries to increase $I_D$ by increasing $V_{gs}$, capacitor 150 is charging up and the voltage presented by voltage divider 170*a*–170*b* to input 112 increases. As discussed above, the comparator will go into the zero voltage output state when $V_{gs}$ transitions above $V_{lim}$. Consequently, the value of $V_{lim}$ determines the maximum drain-source current, $I_D(\max)$, that the soft-start switch circuit of FIG. 4 will allow, where $I_D(\max)=G\cdot V_{lim}$.

Thus, if the gate-source voltage $V_{gs}$ transitions above $V_{lim}$, we have the situation discussed earlier in which the MOSFET is driven OFF, capacitor 90 begins to charge, and diode 220 brings the voltage at input 114 to one diode voltage drop above ground. The start switch will then begin a soft-start power-up once the voltage at input 112 decays to a value less than one diode voltage drop. The utility of diode 220 is now clear. It provides positive feedback, so that just after the voltage at input 112 transitions above the voltage at input 114, it brings the voltage at 114 close to ground so that the time interval needed for the voltage at input 112 to decay below the voltage at input 114 is sufficient for capacitor 90 to be fully charged.

Therefore, the soft-start switch of FIG. 4 limits current through load 55 by turning MOSFET 10 OFF and beginning a soft-start. Consequently, if load 55 is permanently malfunctioning, the soft-start switch of FIG. 4 will repeatedly go through shut-down and soft-start cycling until the malfunctioning load is removed. In the case in which load 55 is a hard-disk drive, a soil-start switch undergoing shut-down and soft-start cycling indicates that the hard-disk drive it powers is malfunctioning and that therefore the system operator can remove the hard-disk drive and hot-plug a new hard-disk drive.

It should be appreciated that the soft-start switch circuit of FIG. 4 accomplishes current limiting without the need of a sense resistor. The power dissipated by the voltage dividers 142–144, 170*a*–170*b*, and 180*a*–180*b* can be made very small by choosing large values for the resistances. In practice, for driving hard-disk drives, the current through these voltage dividers is on the order of milliamps whereas the drain-source current $I_D$ is on the order of amps.

We now consider the effect of capacitor 240 in the circuit of FIG. 4. Capacitor 240 feeds-forward changes in $V_{out}$ to input 114 of comparator 110. If $V_{out}$ is changing slowly relative to the time constant of capacitor 240 and resistors 180*a* and 180*b*, capacitor 240 does not affect the voltage at comparator input 114. However, if $V_{out}$ is changing quickly relatively to the time constant of capacitor 240 and resistors 180*a* and 180*b*, then it will affect input 114. Of primary importance is the case when $V_{out}$ is decreasing quickly, as would be the case during an initial hot plugging of a capacitive load, or if a load were to fail and short the output 50 of the soft-start switch to ground. In this case, capacitor 240 would force the voltage at input 114 to be temporarily lower than it would otherwise be if capacitor 240 were not present. This action effectively lowers the trip threshold of comparator 110 and makes it easier for comparator 110 to turn MOSFET 10 OFF. In fact, for large and fast changes in $V_{out}$, comparator 110 shuts down MOSFET 10 immediately, without waiting for the voltage at node 160 to increase. Thus we see that capacitor 240 aids the soft-start switch in shutting down quickly during an initial hot plugging of a load. Also, we see that capacitor 240 provides for a shut-down of the soft-start switch of FIG. 4 when there is an instantaneous short in load 55 after the soft-start switch has already soft-started load 55.

Capacitors 250 and 260 add additional phase margin to the control loop of the op-amp so that the control loop is stable. Capacitor 270 filters load generated noise in the output voltage of the soft-switch. Capacitors 250, 260, and 270 are not directly relevant to the scope of the present invention, but are included in FIG. 4 because they would be included in a preferred embodiment.

Figure 5:
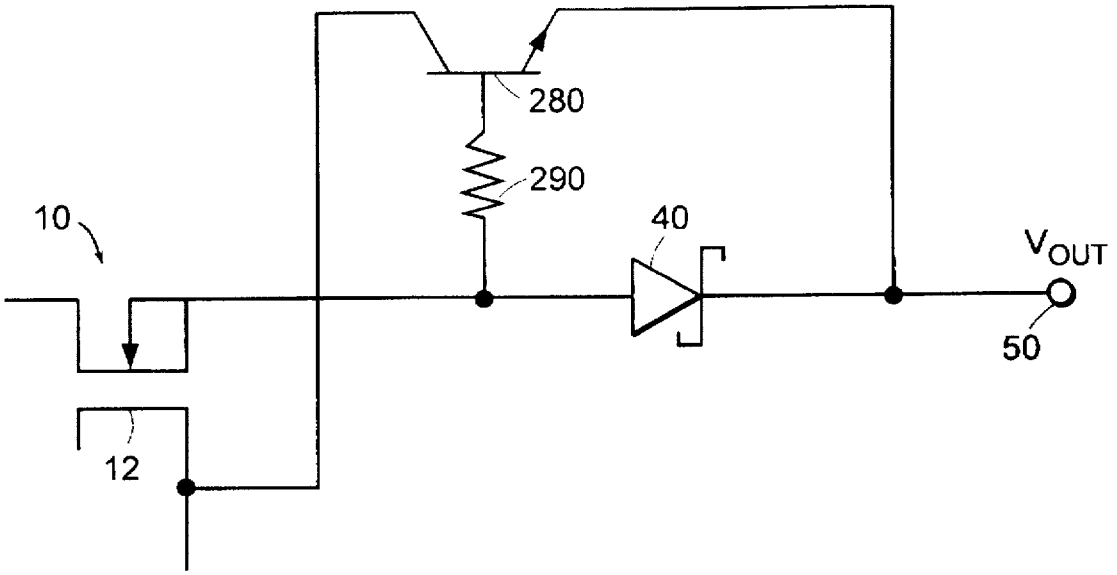
FIG. 5 illustrates an embodiment of the invention with additional circuitry for limiting current when the soft-start switch is in a power-up mode.

An additional transistor and resistor may be added to the circuit as shown in FIG. 5, where in this figure we have only shown the additional components and Schottky diode 40 and MOSFET 10 of FIG. 4. Not shown in FIG. 5 are the remaining components of FIG. 4, which are assumed to be incorporated into FIG. 5. The additional circuitry shown in FIG. 5 is desirable for the following reason. When MOSFET 10 is not near saturation, the transconductance G is larger than for the case when MOSFET 10 is near saturation. Therefore, if a fault in load 55 should occur while the MOSFET is not near saturation, for example when the soft-start switch is in the soft-start power-up mode, then $V_{lim}$ may be set too high for this larger transconductance case and consequently too much drain-source current $I_D$ may be allowed to flow through the MOSFET and into the load. The additional circuitry shown in FIG. 5 can solve this problem depending upon the choice of resistor 290. When an excessive current is drawn through Schottky diode 40, its voltage drop increases, which can bring transistor 280 into conduction, thereby decreasing the voltage of gate 12 and limiting the MOSFET conduction. This effectively opens the control loop and results in the output of op-amp 20 to slew toward $V_{cc}$, resulting in a shutdown as previously described.

Figure 1:
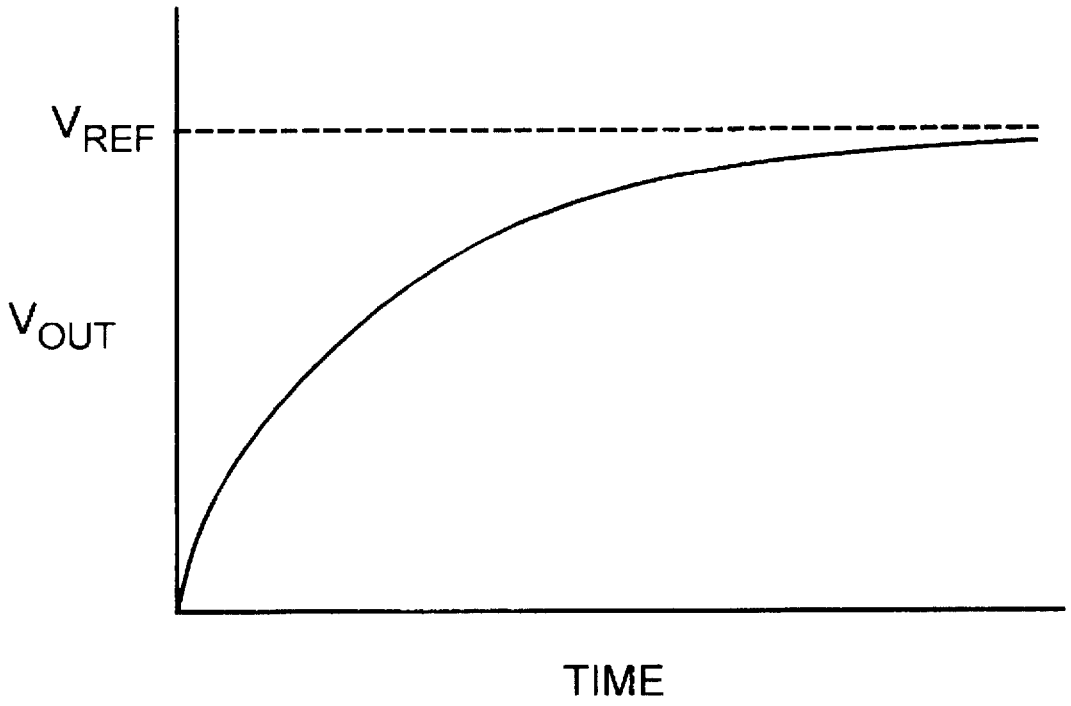
FIG. 1 illustrates a typical output voltage vs. time curve for when a soft-start switch begins a soft-start power-up.

Table 1 provides an example of nominal values for the resistors, capacitors, and voltages in the embodiment of FIGS. 1 and 2 for the case in which the load is a hard-disk drive. Other values may be used.

Numerous modifications may be made to the embodiments described above without departing from the spirit and scope of the invention. For example, it was already discussed that an operable soft-start switch would arise from modifying FIG. 4 in which the terminal of capacitor 90 coupled to input 30 is instead coupled to ground. As another example, FIG. 4 may be modified in which the inverting input 24 of op-amp 20 is coupled directly to output 50 rather than through the voltage divider 142–144. For yet another example, comparator 110 need not be coupled to gate 14 via diode 200. Although such modifications would lead to operable soft-start switches, they are not preferable to the embodiment of FIG. 4 because they would lack some advantages. However, such modifications of FIG. 4, and others, would still result in soft-start switches which employ the transconductance of MOSFET 10 without the need for a current sense resistor. Also, other voltage-controlled current devices other than a MOSFET may be substituted.

TABLE 1

| | |
|---|---|
| resistor 60 | 487 KΩ |
| resistor 130 | 2 KΩ |
| capacitor 90 | 22000 pF |
| resistor 142 | 10 KΩ |
| resistor 144 | 1000 Ω |
| capacitor 250 | 15000 pF |
| capacitor 260 | 15000 pF |
| resistor 145 | 10 KΩ |
| capacitor 150 | 100000 pF |
| capacitor 270 | 1000 pF |
| resistor 116 | 100 KΩ |
| resistors 170a and 170b | 487 KΩ |
| resistors 180a and 180b | 100 KΩ |
| capacitor 240 | 330 pF |
| $V_0$ | 12.8 v |
| $V_{ref}$ | 12 V |
| $V_{cc}$ | 20 V |
| $V_{lim}$ | 5.5 V |

We claim:

1. A soft-start switch, with an input and an output, comprising:

a voltage-controlled current device for controlling a current, with a first terminal, a second terminal, and a third terminal, wherein the second terminal is coupled to the input of the soft-start switch and the third terminal is coupled to the output of the soft-start switch, wherein the current flows between the second and third terminals and is responsive to the voltage difference between the first and third terminals, and wherein the voltage controlled current device has an OFF state;

control means for controlling the voltage at the output of the soft-start switch, with an input and an output wherein the output is coupled to the first terminal of the voltage-controlled current device, wherein the voltage at the output of the soft-start switch is controlled to follow the voltage at the input to the control means; and current limiting means for providing to the input of the control means either a first low impedance to ground or a first high impedance to ground, wherein providing the first low impedance causes the control means to force the voltage-controlled current device into the OFF state, wherein the first low impedance is provided when the voltage difference between the output of the control means and the third terminal of the voltage-controlled current device exceeds a threshold so as to limit current flow between the second and third terminals of the voltage-controlled current device.

2. The soft-start switch as set forth in claim 1, wherein the current limiting means further comprises:

a comparator;

a first diode with its cathode coupled to the output of the comparator and with its anode coupled the input of the control means to provide to the input of the control means the first high impedance to ground when the first diode is reverse biased and the first low impedance to ground when the first diode is forward biased; and means for providing a first voltage to the non-inverting input of the comparator and a second voltage to the inverting input of the comparator, wherein the current limiting means provides to the input of the control means the first low impedance when the second voltage is greater than the first voltage and the first high impedance when the second voltage is less than the first voltage, wherein the second voltage is caused to be greater than the first voltage when the voltage difference between the output of the control means and the third terminal of the voltage-controlled current device exceeds the threshold, wherein after the second voltage is caused to be greater than the first voltage, the second voltage is caused to decay below the first voltage.

3. The soft-start switch as set forth in claim 2, wherein the current limiting means further comprises a second diode with its cathode coupled to the output of the comparator and its anode coupled to the first terminal of the voltage-controlled current device, wherein the current limiting means provides to the first terminal of the voltage-controlled current device a second low impedance to ground when the second voltage is greater than the first voltage to force the voltage-controlled current device into the OFF state, and provides to the first terminal of the voltage-controlled current device a second high impedance to ground when the first voltage is greater that second voltage.

4. The soil-start switch as set forth in claim 3, wherein the current limiting means further comprises a third diode with its cathode coupled to the output of the comparator and its anode coupled to the non-inverting input of the comparator to hold the first voltage at one diode voltage drop above ground when the current limiting means is providing the first and second low impedances.

5. The soft-start switch as set forth in claim 4, wherein the means for providing the first and second voltages further comprises:

a fourth diode with its anode coupled to the output of the control means;

a first capacitor with one terminal coupled to the third terminal of the voltage-controlled current device and another terminal coupled to the cathode of the fourth diode;

a first resistor with a first terminal coupled to the cathode of the fourth diode and a second terminal coupled to the inverting input of the comparator;

a second resistor with a first terminal coupled to the inverting input of the comparator and a second terminal coupled to ground, so that the second voltage decays with a first time constant determined by the first capacitor and first and second resistors when the output of the control means causes the fourth diode to be reversed biased;

a third resistor with a first terminal coupled to the third terminal of the voltage-controlled current device and a second terminal coupled to the non-inverting input of the comparator; and a fourth resistor with a terminal coupled to the non-inverting input of the comparator.

6. The soft-start switch as set forth in claim 5, wherein the current limiting means further comprises a second capacitor with one terminal coupled to the third terminal of the voltage-controlled current device and another terminal coupled to the non-inverting input of the comparator.

7. The soft-start switch as set forth in claim 6, wherein the control means comprises:

an op-amp with its output coupled to the output of the control means and its non-inverting input coupled to the input of the control means;

a fifth resistor with a first terminal coupled to the first terminal of the voltage-controlled current device and a second terminal coupled to the output of the op-amp; and means for providing a third voltage to the inverting input of the op-amp, responsive to the voltage at the output of the soft-start switch.

8. The soft-start switch as set forth in claim 7, further comprising means for providing a fourth voltage to the non-inverting input of the op-amp, wherein the fourth voltage rises from a low soft-start voltage to a high soft-start voltage when the comparator provides the first high impedance, thereby causing the soft-start switch to soft-start a load.

9. The soft-start switch as set forth in claim 8, wherein the means for providing a third voltage comprises:

a sixth resistor with a first terminal coupled to the input of the soft-start switch and a second terminal coupled to the inverting input of the op-amp; and a seventh resistor with a first terminal coupled to the inverting input of the op-amp and a second terminal coupled to the output of the soft-start switch, so that the third voltage is equal to the voltage at the input of the soft-start switch when there is no load coupled to the soft-start switch to thereby keep the voltage-controlled current device in the OFF state.

10. The soft-start switch as set forth in claim 9, wherein the means for providing the fourth voltage comprises:

an eighth resistor with a terminal;

a third capacitor with a first terminal coupled to the terminal of the eighth resistor and a second terminal coupled to the input of the soft-start switch so that the feedback means regulates the voltage drop across the soft-start switch; and a ninth resistor with a first terminal coupled to the first terminal of the third capacitor and a second terminal coupled to the non-inverting input of the op-amp, so that when the comparator provides the first high impedance the fourth voltage rises from the low soft-start voltage to the high soft-start voltage with a second time constant determined by the eighth resistor and third capacitor.

11. The soft-start switch as set forth in claim 10, wherein the voltage-controlled current device comprises a MOSFET with gate, drain, and source coupled respectively to the first, second, and third terminals of the voltage-controlled current device.

12. The soft-start switch as set forth in claim 2, wherein the current limiting means further comprises positive feedback means coupling the output of the comparator to its non-inverting input for bringing the first voltage to a predetermined voltage above ground whenever the current limiting means is providing the first low impedance.

13. A soft-start switch, with an input and an output, comprising:

a voltage-controlled current device with a first terminal, a second terminal, and a third terminal, wherein the second terminal is coupled to the input of the soft-start switch and the third terminal is coupled to the output of the soft-start switch, wherein there is a transconductance relationship between a device current flowing between the second and third terminals and the voltage difference between the first and third terminals, wherein the voltage-controlled current device has an OFF state;

a first circuit with a first input, a second input, and an output coupled to the first terminal of the current device, wherein the second input is coupled to the output of the soft-start switch and the output of the first circuit is responsive to the voltage difference between the first and second inputs so that the first circuit and the voltage-controlled current device form part of a feedback loop wherein the voltage at the output of the soft-start switch to which a load is coupled is controlled to follow the voltage at the first input of the first circuit;

a second circuit with a first input responsive to a first voltage, a second input responsive to a second voltage, and an output coupled to the first input of the first circuit via a first diode, wherein the voltage of the output is a first value when there is a first relationship between the first and second voltages and the voltage of the output is a second value when there is a second relationship between the first and second voltages, wherein the first value is larger than the second value, wherein the first diode is reverse biased when the voltage of the output is at the first value, wherein the voltage-controlled current device is forced into the OFF state when the voltage of the output is at the second value;

a reference voltage circuit coupled to the first input of the first circuit for providing a soft-start voltage to the first input of the first circuit, wherein the soft-start voltage rises from a low soft-start voltage to a high soft-start voltage when the first diode is reverse biased; and means for providing the first and second voltages to the first and second inputs, respectively, of the second circuit, wherein the means for providing the first and second voltages is coupled to the output of the First circuit and to the third terminal of the voltage-controlled current device, wherein the second relationship holds among the first and second voltages when the difference in voltages between the output of the first circuit and the third terminal of the voltage-controlled current device exceeds a threshold so that the voltage-controlled current device is forced into the OFF state and the device current is prevented from exceeding a maximum current value where the maximum current value is related to the threshold by the transconductance relationship.

14. The soft-start switch as set forth in claim 13, wherein whenever the second relationship is caused to hold among the first and second voltages the means for providing the first and second voltages will cause the first relationship to hold among the first and second voltages at a time interval after the occurrence of the second relationship, so that the soft-start voltage rises from the low soft-start voltage to the high soft-start voltage and the soft-start switch provides a soft-start to a load coupled to the soft-start switch.

15. The soft-start switch as set forth in claim 14, wherein the first relationship holds when the first voltage is greater than the second voltage and the second relationship holds when the first voltage is less than the second voltage.

16. The soft-start switch as set forth in claim 14, wherein the means for providing the first and second voltages to the first and second inputs, respectively, of the second circuit further comprises a first capacitor with one terminal coupled to the third terminal of the voltage-controlled current device and the other terminal coupled to the first input of the second circuit.

17. The soft-start switch as set forth in claim 14, wherein the second circuit further comprises:

a comparator with its output coupled to the output of the second circuit, and its non-inverting and inverting inputs coupled respectively to the first and second inputs of the second circuit, wherein the first diode's cathode is coupled to the output of the comparator and its anode is coupled to the first input of the first circuit;

a second diode with its cathode coupled to the output of the comparator and its anode coupled to the first terminal of the voltage-controlled current device; and a third diode with its cathode coupled to the output of the comparator and its anode coupled to the first input of the comparator.

18. The soft-start switch as set forth in claim 14, further comprising means for coupling the second input of the first circuit to the output and the input of the soft-start switch, wherein the voltage of the second input to the first circuit is equal to the voltage at the input of the soft-start switch when no load is coupled to the output of the soft-start switch so that the voltage-controlled current device is in the OFF state when no load is coupled to the soft-start switch.

19. The soft-start switch as set forth in claim 14, wherein the reference voltage circuit comprises an RC circuit with its capacitor coupled to the input of the soft-start switch, so that the voltage drop across the soft-start switch is regulated and the soft-start voltage rises from the low soft-start voltage to the high soft-start voltage with a time constant determined by the RC circuit when the output voltage of the second circuit transitions from the second value to the first value.

20. The soft-start switch as set forth in claim 14, wherein the output of the first circuit is coupled to the first terminal of the voltage-controlled current device via a first resistor.

21. The soft-start switch as set forth in claim 17, wherein the first circuit comprises an op-amp with its non-inverting input coupled to the first input of the first circuit, its inverting input coupled to the second input of the first circuit, and its output coupled to the output of the first circuit.

22. The soft-start switch as set forth in claim 14, wherein the second circuit further comprises positive feedback means coupling the output of the second circuit to its first input for bringing the first voltage to a predetermined voltage above ground whenever the voltage of the output of the second circuit is at the second value.

23. A soft-start switch, with an input and an output, comprising:

a FET (field-effect transistor) with a gate, drain, and source;

a first resistor with a first terminal coupled to the gate of the FET;

an op-amp with its output coupled to a second terminal of the first resistor;

a first diode with its anode coupled to the non-inverting input of the op-amp;

a comparator with its output coupled to the cathode of the first diode;

a second diode with its cathode coupled to the output of the comparator and its anode coupled to the gate of the FET;

a third diode with its cathode coupled to the output of the comparator and its anode coupled to the non-inverting input of the comparator; and means for providing a first voltage and a second voltage to the non-inverting and inverting inputs of the comparator, respectively, wherein the second voltage is caused to be greater than the first voltage when the voltage difference between the output of the op-amp and the source of the FET exceeds a threshold, wherein after the second voltage is caused to be greater than the first voltage, the second voltage decays to a value less than the first voltage, so that the comparator reverse biases the first and second diodes once the second voltage decays below the first voltage.

24. The soft-start switch as set forth in claim 23, further comprising:

a second resistor with a first terminal coupled to the input of the soft-start switch and a second terminal coupled to the inverting input of the op-amp; and a third resistor with a first terminal coupled to the inverting input of the op-amp and a second terminal coupled to the output of the soft-start switch.

25. The soft-start switch as set forth in claim 24, further comprising:

a fourth resistor;

a first capacitor with a First terminal coupled to a terminal of the fourth resistor and a second terminal coupled to the input of the soft-start switch; and a fifth resistor with a first terminal coupled to the first terminal of the capacitor and a second terminal coupled to the non-inverting input of the op-amp.

26. The soil-start switch as set forth in claim 25, wherein the means for providing the first and second voltages comprises:

a fourth diode with its anode coupled to the output of the op-amp;

a second capacitor with a first terminal coupled to the source of the FET and a second terminal coupled to the cathode of the fourth diode;

a sixth resistor with a first terminal coupled to the inverting input of the comparator and a second terminal coupled to the cathode of the fourth diode;

a seventh resistor with a first terminal coupled to ground and a second terminal coupled to inverting terminal of the comparator;

an eight resistor with a first terminal coupled to the non-inverting input of the comparator and a second terminal coupled to the source of the FET; and a ninth resistor with a first terminal coupled to the non-inverting input of the comparator.

27. The soft-start switch as set forth in claim 26, wherein the means for providing the first and second voltages further comprises a third capacitor with a first terminal coupled to the non-inverting input of the comparator and a second terminal coupled to the source of the FET.

28. A method for voltage regulation and current limiting in a soft-start switch, comprising the steps of:

applying a first voltage to a first resistor coupled to a first terminal of a voltage-controlled current device, wherein the voltage-controlled current device has a second terminal and a third terminal and there is a transconductance relationship between a device current flowing between the second and third terminals and a voltage difference between the first and third terminals, wherein the voltage-controlled current device has an OFF state;

adjusting the first voltage in response to the difference between a first non-inverting voltage and a first inverting voltage, so that the first voltage is a non-decreasing function of the difference between the first non-inverting and first inverting voltages and the first voltage is substantially zero when the difference between the first non-inverting and first inverting voltages is substantially zero, wherein the first inverting voltage is responsive to an output voltage of the soft-start switch, to provide a feedback control loop in which the output voltage of the soft-start switch is controlled to follow the first non-inverting voltage when a load is coupled to the soft-start switch;

bringing the first non-inverting voltage to a first low value and the voltage at the first terminal of the voltage-controlled current device to a second low value when a second inverting voltage is greater than a second non-inverting voltage to put the voltage-controlled current device into the OFF state;

causing the first non-inverting voltage to rise from the first low value to a first reference voltage when the second non-inverting voltage is greater than the second inverting voltage, wherein the first reference voltage is not greater than an input voltage to the soft-start switch, to provide a soft-start when a load is coupled to the soft-start switch so that the output voltage of the soft-start switch will gradually rise to the first reference voltage;

causing the second inverting voltage to be greater than the second non-inverting voltage when the difference between the first voltage and the voltage of the third terminal of the voltage-controlled current device exceeds a threshold, so that the voltage-controlled current device is in the OFF state; and causing the second inverting voltage to decay below the second non-inverting voltage whenever the second inverting voltage has been caused to exceed the second non-inverting voltage, allowing the soft-start switch to soft-start a load coupled thereto.

29. The method as set forth in claim 28, further comprising the step of bringing the second non-inverting voltage to a predetermined voltage above ground whenever the second inverting voltage has been caused to exceed the second non-inverting voltage.

30. The method as set forth in claim 29, wherein the first inverting voltage is responsive to the output and input voltages of the soft-start switch via a first voltage divider, so that the first inverting voltage is equal to the input voltage of the soft-start switch and the voltage-controlled current device is in an OFF state when no load is coupled to the soft-start switch.

31. The method as set forth in claim 30, further comprising the step of:

causing the second inverting voltage to exceed the second non-inverting voltage when a capacitive load has been hot-plugged to the soft-start switch.

32. The method as set forth in claim 31, further comprising the step of:

causing the second non-inverting voltage to fall below the second inverting voltage, after the soft-start switch has been in a steady state with a properly functioning load coupled to its output, when the output voltage of the soft-start switch is suddenly brought substantially equal to zero due to a short in the load coupled thereto.

33. The method as set forth in claim 30, wherein:

the second non-inverting voltage is the voltage at the internal node of a second voltage divider with one end coupled to a voltage source, another end coupled to the third terminal of the voltage-controlled current device, and a first capacitor coupled with one terminal coupled to the internal node of the second voltage divider and another terminal coupled to the third terminal of the voltage-controlled current device; and the second inverting voltage is the voltage at the internal node of a third voltage divider with one end grounded and another end responsive to the first voltage via a diode and coupled to a second capacitor wherein the second capacitor is coupled to the third terminal of the voltage-controlled current device.

34. The method as set forth in claim 32, further comprising the step of bringing the second non-inverting voltage to a predetermined voltage above ground whenever the second inverting voltage has been caused to exceed the second non-inverting voltage.

* * * * *

UNITED STATES PATENT AND TRADEMARK OFFICE

CERTIFICATE OF CORRECTION

PATENT NO. : 5,698,973

DATED : December 16, 1997

INVENTOR(S) : Ulrich B. Goerke and Mark S. Pieper

It is certified that error appears in the above-identified patent and that said Letters Patent is hereby corrected as shown below:

Column 10, line 43, change "that" to --than the--
Column 10, line 44, change "soil-start" to --soft-start--
Column 12, line 52, change "First" to --first--
Column 14, line 35, change "First" to --first--
Column 14, line 41, change "soil-start" to --soft-start--

Signed and Sealed this

Twenty-eighth Day of April, 1998

Bruce Lehman

*Attest:*

BRUCE LEHMAN

*Attesting Officer*

*Commissioner of Patents and Trademarks*